8/1/78 XR 4,104,303

United States Patent [19]

Anderson et al.

[11] 4,104,303

[45] Aug. 1, 1978

[54] ACID INHIBITOR COMPOSITION AND PROCESS IN HYDROFLUORIC ACID CHEMICAL CLEANING

[75] Inventors: James Douglas Anderson, Ambler; Edgar S. Hayman, Jr., Doylestown; Edward A. Rodzewich, Flourtown, all of Pa.

[73] Assignee: Amchem Products, Inc., Ambler, Pa.

[21] Appl. No.: 717,971

[22] Filed: Aug. 26, 1976

Related U.S. Application Data

[62] Division of Ser. No. 595,974, Jul. 14, 1975, Pat. No. 3,992,313.

[51] Int. Cl.[2] ..... C23G 1/06; C07C 85/18

[52] U.S. Cl. ..... 260/570.9; 252/148; 260/563 P; 260/584 A

[58] Field of Search ..... 260/584 A, 570.9, 563 P; 252/148, 392; 134/3, 41

[56] References Cited

U.S. PATENT DOCUMENTS

| | | | |
|---|---|---|---|
| 2,758,970 | 8/1956 | Saukaitis et al. | 252/148 X |
| 3,630,933 | 12/1971 | Dudlik et al. | 252/148 X |

*Primary Examiner*—Harris A. Pitlick
*Attorney, Agent, or Firm*—Dale Lynn Carlson

[57] ABSTRACT

A Mannich base and thiourea inhibitor composition and method of inhibiting the acid attack by aqueous hydrofluoric acid on ferrous metal surfaces, and in particular, highly reactive ferrous metal surfaces.

4 Claims, No Drawings

ACID INHIBITOR COMPOSITION AND PROCESS IN HYDROFLUORIC ACID CHEMICAL CLEANING

This is a division of application Ser. No. 595,974, filed July 14, 1975, now U.S. Pat. No. 3,992,313.

BACKGROUND OF THE INVENTION

1. Field of the Invention

The present invention relates to new and useful corrosion inhibitors for reducing the acid attack on or corrosion rate of, a ferrous metal surface by acidic chemical cleaning solutions. More particularly, the present invention concerns employing a novel inhibitor composition in an aqueous acidic hydrofluoric acid cleaning solution to materially reduce the acid attack on ferrous metal surfaces and particularly on surfaces of highly acid-reactive ferrous metals.

2. Description of the Prior Art

Metal surfaces have been cleaned of oxide scale incrustations by employing aqueous solutions of strong and weak acids, in which there is often employed an inhibitor to reduce the attack of the aqueous acidic solution on the metal surface. For example, mineral acids such as sulfuric, sulfamic, hydrochloric and phosphoric acids have been employed for scale removal and metal cleaning. Frequently organic acids such as formic, acetic, citric, propionic, and the like have been employed also for metal cleaning. When such acid cleaning solutions have been employed for the removal of oxide scale and mineral incrustation on a ferrous metal surface, the metal surface is also attacked.

To reduce the attack of acid solutions on the metal surface, it has been known, for example from U.S. Pat. No. 3,077,454 to employ a reaction product of an active hydrogen-containing compound, an alpha ketone, an aldehyde and a fatty acid.

The active hydrogen compound employed therein is an organic ammonia derivative having at least one hydrogen atom attached to a nitrogen. Such active hydrogen compounds thus include, inter alia, primary and secondary amines, diamines, amides, ureas, thioureas, ammonia, ammonium salts, alicyclic amines and the like.

From U.S. Pat. No. 3,634,270 it is known to employ the reaction product of U.S. Pat. No. 3,077,454 together with a sulfur compound to prevent the corrosion of metals in contact with corrosive materials such as HCl, $H_2SO_4$ or alkylene diamine tetracetic acid partially ammoniated salt. The sulfur compound can be thiourea, its aliphatic homologs, sulfides, thiocyanates, cyanates and the like.

It is known from U.S. Pat. No. 2,959,555 to employ a urea derivative in a hydrochloric, sulfuric or phosphonic acid solution to remove copper containing iron oxide incrustation from an iron surface. Such a solution can also employ an organic nitrogen-base type of corrosion inhibitor.

Mannich bases and particularly rosin amine Mannich base reaction products have been found useful for inhibiting the attack of a metal surface by acid solutions. For example, from U.S. Pat. No. 2,758,970 it is known that a rosin amine — formaldehyde — ketone reaction product is useful for the protection of ferrous metals during the removal of water-borne deposits, of heat scale and of rust where removal is carried out by means of acid salts or acids such as hydrochloric, sulfuric, acetic, formic and the like.

Various other nitrogen-containing inhibitor bases have been employed to reduce the attack on metal surfaces by acidic solutions. For example it is known from U.S. Pat. No. 3,668,137 to employ such an "inhibitor base" together with a carboxylic acid and a sulfonium salt to inhibit acid attack of a metallic surface. The "inhibitor base" can be a nitrogen-containing compound such as the coal tar bases (pyridine and its derivatives) and their quaternary salts, alkyl amines, aryl amines, ethylene oxide condensates of amines, and coal tar Mannich bases which in themselves have acid attack inhibiting properties. The "inhibitor base" alternatively can be a nitrogen-containing compound such as an amide, urea, thiourea, acetamide, formamide, and 1-phenyl-2-thiourea.

Acid cleaning solutions employing acid inhibitors of the types described above have been quite satisfactory for many purposes. Recently, with the advent of nuclear fuels coupled with increased demand for more power, now construction materials have been required for boiler walls, super heaters, and the like. To efficiently accomodate the higher temperatures required to produce more power with greater efficiency, steel alloys comprising chromium, copper, and magnesium have been employed. These steel alloys also frequently contain nickel, molybdenum, aluminum, and columbium. When it has been desired to clean such steel alloys of deposited scale and metal oxides, aqueous acidic solutions as were used on the more common alloys, comprising about 5% of hydrochloric acid have been employed. Of course such cleaning solutions contained inhibiting compositions to reduce the metal dissolution rate of the metal surface in contact with the cleaning solution. The steel alloys from which some boiler walls, super heaters and the like are constructed are so highly reactive with the acidic cleaning solutions that excessive losses of both acid and steel alloy were experienced and yet cleaning required from 24 to 48 hours.

It was then found in the art that hydrofluoric acid was a more efficient solvent of scale and metal oxides. A satisfactory acidic cleaning solution can employ hydrofluoric acid in the amount of about 1 or 2% by weight. Moreover, the cleaning time could be cut in half over that required by the hydrochloric acid solutions.

However, most known inhibiting compositions have been found to be unsuitable for inhibiting the acid attack of an aqueous cleaning solution based on hydrofluoric acid. Many known inhibitors, or inhibiting compositions either decompose in a hydrofluoric acid cleaning solution or interact at the metal surface in contact with the inhibited cleaning solution, causing a darkened surface appearance. Most known inhibitors, when used to protect a ferrous metal surface during an aqueous hydrofluoric acid cleaning operation have been found to be totally inadequate for protecting the highly reactive steel alloys, and in fact, frequently completely lose their protective influence above about 50° to 60° C. Generally the known inhibiting compositions fail to provide sufficient protection against acid attack by hydrofluoric acid cleaning solutions in contact with the highly reactive metal surfaces particularly when it is desired to inhibit the acid attack such that metal dissolution is less than about 1.01 $g/m^2/hr$.

SUMMARY OF THE INVENTION

With the foregoing problems in mind, it is the primary object of this invention to provide an inhibitor composition which, when added to an acidic aqueous solution wherein the acid employed is hydrofluoric acid, substantially reduces the acid attack of the solution on the metal surface.

It is another object of this invention to provide an inhibitor composition which can be employed in a hydrofluoric acid cleaning solution for removing scale and metal oxides from surfaces of ferrous metals, particularly highly reactive steel alloys.

It is another object of this invention to effect an acid cleaning of a metal surface wherein the surface is cleaned of scale and metal oxides and is substantially free of acid attack, that is, the attack rate can be less than about 1.01 $g/m^2/hr$.

Accordingly, this invention is based upon an inhibitor composition comprising a Mannich base and thiourea for inhibiting the attack on a ferrous metal surface by a hydrofluoric acid cleaning solution.

"Mannich base" means herein a methylamination reaction of the Mannich type comprising a condensation reaction product of a primary or secondary amine, an alpha ketone, and formaldehyde. "Rosin amine Mannich base" means a reaction product of the above type wherein the amine reactant is a rosin amine.

The terms "HF cleaning solution" or "hydrofluoric acid cleaning solution" mean herein an aqueous acidic solution wherein the acid employed consists essentially of hydrofluoric acid.

The terms "metal" or "metal surfaces" refer to the ferrous metals and alloys thereof, and surfaces composed predominantly of iron; but includes such other metals and in such amounts as are found in steel alloys, for example, chromium, copper, magnesium, molybdenum, aluminum, nickel and the like.

DETAILED DESCRIPTION OF THE INVENTION

When a hydrofluoric acid cleaning solution is employed to remove metal oxides and deposited scales or mineral incrustations from a metal surface, and particularly a ferrous metal surface, it has now been discovered that an inhibitor composition comprising a Mannich base together with thiourea reduces the acid attack on the metal surfaces.

To prepare the composition of the invention it is preferred to first prepare the Mannich base. In preparing the Mannich base, a nitrogen compound having at least one active hydrogen attached to a nitrogen atom, for example a primary amine or a secondary amine, is reacted with an alpha ketone and formaldehyde in the presence of an acid. Exemplary of the ketone reactant is: acetone, methylethyl ketone, isobutylmethyl ketone; diacetone alcohol; 2,4-pentanedione; acetonylacetone; phorone; mesityl oxide; cyclopentanone, propiophenone; acetonaphthone; acetophenone; p-methoxyacetophenone; p-chloroacetophenone; 2-heptanone; 2-undecanone; 2-acetylcyclohexanone; butyrophenone; naphthalenone; cyclohexanone; and tetrolophenone.

Examples of various types of Mannich bases which can be used are defined by the three formulae set forth below:

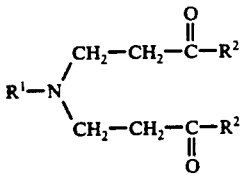

(Formula I)

-continued

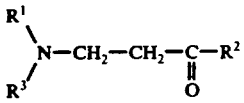

(Formula II)

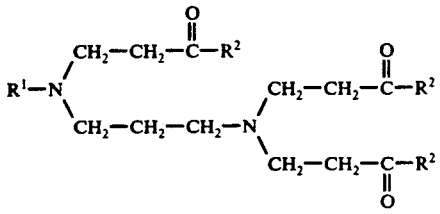

(Formula III)

wherein $R^1$ and $R^3$ each represents hydrogen or a hydrocarbon radical such as, for example, alkyl, alkenyl, aralkyl, aryl and cyclic groups including polycyclic, cycloalkyl and heterocyclic groups; and wherein $R^2$ represents a hydrocarbon radical such as, for example, alkyl, alkenyl, aralkyl, aryl and cyclic groups including polycyclic, heterocyclic and cycloalkyl groups. Examples of these radicals include methyl, isopropyl, octadecyl, dodecyl, decenyl, octenyl, benzyl, phenyl, naphthyl, cyclopentyl, cyclohexyl and thiazolyl.

This class of compounds is disclosed in U.S. Pat. No. 3,668,137 which is hereby incorporated by reference.

A preferred class of Mannich bases for use in the acid inhibitor composition of this invention is a rosin amine Mannich base. This class of compounds, as well as their preparation, are disclosed in U.S. Pat. No. 2,758,970, the disclosure of which is hereby incorporated by reference. This class of Mannich bases includes derivatives of amine compounds which have acid inhibition properties. This class of preferred Mannich bases is exemplified by the formula:

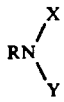

(Formula IV)

wherein R is a radical selected from the group consisting of abietyl, hydroabietyl and dehydroabietyl; Y is the group, $CH_2R^1$; X is a radical selected from the group consisting of hydrogen, and — $CH_2R^1$; and $R^1$ represents an alpha ketonyl group.

To catalyze the Mannich reaction, hydrochloric acid is generally used, though other acids, for example hydrobromic, acetic or sulfuric have been employed. Surprisingly, when hydroxyacetic acid is employed in place of the acids known to be employed, certain benefits are found which are disclosed hereinbelow.

In addition to the Mannich base, thiourea is employed in the inhibitor composition of the invention.

Thiourea employed together with the Mannich base, and preferably together with the rosin amine Mannich base in an HF cleaning solution, enhances the inhibiting ability of the Mannich base and aids in protecting the metal surface from acid attack.

As a measure of the inhibition of acid attack, the dissolution rate of the metal surface can be determined. Unexpectedly, a dissolution rate can be obtained that is substantially less than 1.01 $g/m^2/hr$. in a process employing an HF cleaning solution having therein a composition comprising a rosin amine Mannich base and thiourea.

It has been found that the inhibitor composition is best handled, and added to an HF cleaning solution when employed in the form of a liquid concentrate. To aid in dissolving the Mannich base and thiourea in the HF cleaning solution it has been found beneficial to employ nonionic surfactants. Such surfactants further facilitate the cleaning action of the HF cleaning solution. Aid in the cleaning action is particularly realized when oily or grease based soils are present on the metal surface. Of course the surfactant must be acid stable. The amount of surfactant added is not critical and can easily be determined by observing the dissolution of the composition in the HF cleaning solution. The amount of surfactant can also depend on the condition of the surface to be cleaned and can easily be adjusted by observing the cleaning action. Nonionic surfactants of the class of alkyl aryl polyethoxy alcohols have been found suitable. The alkyl aryl polyethoxy alcohol surfactants preferred are those having an HLB (hydrophilic-lipophilic balance) of from about 12.8 to about 17.3. Examples of suitable surfactants, inter alia, are those available commercially as Triton N-150, Igepal CO-850 and Surfonic N-150.

Simple solvents can additionally be added to the liquid concentrate to facilitate easy addition of a concentrate to the HF cleaning solution.

In this regard, water can also be beneficially employed. Water can additionally aid in dissolving the thiourea during preparation of a liquid concentrate. It is not necessary to add water per se to the composition, however. The water present in the commercial forms of ingredients employed during preparation of the Mannich base can be sufficient. For example, the formaldehyde can be in the form of commercial formalin having about 37% formaldehyde, the balance being water. The acid employed in preparing the Mannich base can be, for example, hydrochloric acid at 20° Bé or hydroxyacetic acid of 70% concentration, the balance being water. Of course additional acid, preferably one corresponding to the acid used in preparing the Mannich base, can also subsequently be used in preparing the liquid concentrate. A stable liquid concentrate comprising the inhibitor composition results, which is readily miscible in an HF cleaning solution and is easily measured and added thereto.

It has occasionally been found desirable to eliminate all traces of chloride from HF cleaning solutions. Certain ferrous surfaces, particularly of a highly reactive nature, incur types of corrosion failure known commonly as "stress cracking" and "pitting" when chlorides are present in the cleaning bath.

To substantially eliminate chlorides from the HF cleaning solution, the inhibitor composition employed in such an acid cleaning solution must be substantially free of chloride ion. Accordingly, it is preferable when employing an HF cleaning solution on the highly reactive steels to employ a Mannich base which is substantially free of chloride in preparing the composition of the invention. In this regard it is desirable to replace the commonly employed acid catalyst employed in the Mannich type reaction with one free of chloride.

While acids such as are known to be employed in catalyzing the Mannich reaction are suitable in many applications, it is essential for preparing an inhibitor composition which is substantially free of chloride ion, that an acid free of chloride be employed. Acids free of chloride which can be used include, for example, phosphoric acid, hydroxyacetic acid, acetic acid, sulfuric acid and formic acid. Of these acids, it is preferable to employ hydroxyacetic acid for several reasons. Advantageously, hydroxyacetic acid employed in the Mannich type reaction, (1) yields a reaction product easily, (2) readily yields a liquid product, and (3) the reaction goes to completion.

Surprisingly, when hydroxyacetic acid is employed for catalyzing the Mannich type reaction, and again added subsequently with addition of the thiourea in preparing the inhibitor composition, a liquid concentrate results wherein thiourea is maintained in solution during long storage periods, during which periods the inhibitor composition can be subjected to repetitive periods of freezing and thawing without adversely affecting the inhibitor composition, that is, the constituents remain in solution and the composition is readily miscible in an HF cleaning solution.

While various substitutions can be made within the scope of the invention, it is only essential that the inhibitor composition be comprised of a Mannich base and thiourea. Surfactants, acids, water and lower alcohols hereinabove mentioned, (1) enable homogeneity of the inhibitor concentrate, (2) increase miscibility of the Mannich base and thiourea in the HF cleaning solution, and (3) dilute the constituents to provide a desired concentration of the product. They can additionally assist the HF cleaning solution in the removal of contaminants on the metal surface. For example, removal of oily or grease-based soils is facilitated thereby.

Examples of concentrate products of the inhibitor composition are those according to Formula A and Formula B below.

| Formula A | g/l |
|---|---|
| Rosin amine Mannich base (condensation product of a rosin amine -- Amine 750, acetophenone, acetone and formaldehyde -- 37%, in the presence of HCl -- 20° Bé) | 387 |
| Triton N-150 (alkyl aryl polyethoxyethanol) | 85 |
| Igepal CO-850 (nonyl phenoxy polyethoxyethanol) | 267 |
| Isopropanol | 108 |
| Hydrochloric acid (20° Be) | 43 |
| Water | 5 |
| Thiourea | 207 |

| Formula B | g/l |
|---|---|
| Rosin amine Mannich base (condensation product of a rosin amine -- Amine D, acetophenone, acetone and formaldehyde -- 37%, in the presence of hydroxyacetic acid -- 70%) | 387 |
| Surfonic N-150 (alkyl aryl polyethoxyethanol) | 85 |
| Igepal CO-850 (nonyl phenoxy polyethoxyethanol) | 267 |
| Isopropanol | 108 |
| Hydroxyacetic acid (70%) | 43 |
| Water | 5 |
| Thiourea | 207 |

A concentrate, for example one according to Formula A or Formula B above, can be added to an HF cleaning solution in an amount from about 0.01% to about 2.0% by volume, and even higher if desired. For superior performance it is preferred to employ such a concentrate in an HF cleaning solution in an amount from about 0.1% to about 0.8% by volume. A suitable concentrate comprising the Mannich base and thiourea is one wherein the Mannich base is present in the amount of from about 0.0044 to about 1107 parts by weight and preferably from about 0.09 to about 150 parts by weight for each part by weight of thiourea.

Of course, the inhibitor composition must be present in an HF cleaning solution in an amount which is effective for reducing the acid attack to an acceptable rate. Accordingly when employed in an HF cleaning solution, the inhibitor composition is present therein such that the Mannich base is present in an amount of from about 0.035 g/l to about 7.75 g/l. Preferably the Mannich base is present in the HF cleaning solution in an amount of from about 0.35 g/l to about 3 g/l. In like manner it has been found that the amount of thiourea in the HF cleaning solution should be from about 0.007 g/l to about 8 g/l and preferably from about 0.02 g/l to about 4 g/l for a minimized acid attack rate.

For cleaning iron surfaces, particularly surfaces comprised of the highly reactive ferrous alloys, wherein a hydrofluoric acid cleaning solution is beneficially employed, the concentration of the hydrofluoric acid can be from about 1 weight percent to about 5 weight percent but is preferably employed in the amount of about 1 - 2 weight percent. The hydrofluoric acid cleaning solution loosens and dissolves oxides of iron, for example magnetite, ferrite and hematite, and mineral deposits at a rate substantially faster than is possible with hydrochloric acid. At the same time, the hydrofluoric acid cleaning solution aggressively attacks the ferrous surface. The addition of the inhibitor composition to an HF cleaning solution reduces the acid attack without adversely affecting the cleaning action. The addition of the inhibitor composition to an HF cleaning solution as described herein constitutes an "inhibited HF cleaning solution".

As stated previously, the presence of chloride in the cleaning solution can result in an increased tendency for the highly reactive alloys of iron to exhibit corrosion of the types known as "pitting corrosion" and "stress corrosion". Hence when these corrosion problems arise, it is preferred to employ an inhibited HF cleaning solution free of chloride, that is an HF cleaning solution in which the chloride free inhibitor composition previously described is employed.

When employing the inhibited HF cleaning solution for cleaning a ferrous metal surface, any method by which the surface can be brought in contact with the solution is suitable. Thus, objects which can conveniently be immersed can be cleaned by this method. However, when the surface to be cleaned comprises the inner surface of a boiler the solution can simply be injected into the boiler. At the injection point, the inhibitor and hydrofluoric acid is injected into the water stream at a rate which finally results in the proper inhibitor and acid dilution.

Cleaning is preferably carried out at a temperature of about 50° C. However temperatures of from about 10° C to about 100° C can be employed without adversely affecting the operation of the solution.

In the examples to follow, the highly reactive steel alloys which are employed are those, for example, known according to ASTM A-335 as grades P-1, P-11 and P-12, and by Mannesmann Rohrenwerke (Germany) as KWA and WB-36. The elements present in these alloys are shown hereinbelow in Table 1. Also shown for comparison purposes, is the composition of 1010 hot-rolled steel.

TABLE 1

| | 1010 | P-1 | P-11 | P-12 | KWA | WB-36 |
|---|---|---|---|---|---|---|
| C | .05 - .15 | .15 | .10 | .11 | .06 | .15 |
| Si | — | .29 | .72 | .37 | .40 | .30 |
| Mn | .30 - .60 | .48 | .43 | .45 | .40 | 1.06 |
| Ni | — | — | — | — | — | 1.0 |
| Cu | — | — | — | — | — | .55 |
| Mo | — | .54 | .53 | .58 | — | .35 |
| Nb | — | — | — | — | — | .034 |
| Cr | — | — | 1.25 | 1.97 | 17.0 | .30 |
| Al | — | — | — | — | — | .037 |
| P | .040 max. | .009 | .006 | .013 | — | .011 |
| S | .050 max. | .021 | .009 | .023 | — | .011 |

To aid in understanding the invention and the usefulness thereof, there is provided hereinbelow solutions and comparative tests pertinent to the inhibitor composition which are presented as examples and should not be construed to limit the invention in any way.

EXAMPLE 1

A Mannich base and thiourea composition was prepared by first preparing a Mannich base. The Mannich base was prepared in a 2-step process. In the first step a rosin amine (Amine-D) in the amount of 142 grams was reacted in the presence of hydrochloric acid with 47 grams of acetophenone and 59 grams of formaldehyde (37%) in a reaction vessel at a temperature of 90° C.

In the second step, 58 grams of additional formaldehyde (37%) and 152 grams of acetone were added to and reacted with the reaction product of the first step at a temperature of 70° C. After the reaction had gone to completion, any excess reactants (primarily acetone) were separated from the reaction products by distillation.

To the resulting reaction product (the product of the Mannich type reaction), was added with stirring, 85 grams of Triton N-150 (alkyl aryl polyethoxyethanol), 267 grams of Igepal CO-850 (nonylphenoxy polyethoxyethanol nonionic surfactant), 5 grams of water, 108 grams of isopropanol, 43 grams of hydrochloric acid and 207 grams of thiourea. One liter of solution was obtained.

EXAMPLE 2

A Mannich reaction product base was prepared in the same manner as in Example 1 above, except that in place of hydrochloric acid, hydroxyacetic acid (70%) was employed. To the resulting Mannich type reaction product was added with stirring, 85 grams of Triton N-150 (alkyl aryl polyethoxyethanol), 267 grams of Igepal CO-850 (nonylphenoxypolyethoxyethanol), 43 grams of hydroxyacetic acid (70%), 207 grams of thiourea, 5 grams of water and 108 grams of isopropanol, to make 1 liter of solution.

EXAMPLE 3

A concentrate prepared according to Example 2 above was added to a 1% by weight hydrofluoric acid solution in the amount of from about 0.1 to 0.6 percent by volume. Metal coupons of the highly reactive steel alloys KWA and WB-36 were immersed for periods of 4 hours each in the test solutions. From the results it will be seen that the attack rate of the acid cleaning solution on the metal coupons was less than about 1 gram per square meter per hour when the concentrate was employed in the acid cleaning solution in an amount greater than 0.1 percent by volume. The temperature of the solution was maintained at 90° C. The attack rate on the metal surface was calculated from a determination of the weight loss from the metal coupon. The results are compiled in Table 2.

TABLE 2

| Inhibitor composition concentration* (%/vol.) | Acid attack rate ($g/m^2/hr.$) | |
|---|---|---|
| | WB-36 metal | KWA metal |
| 0.1 | 2.81 | 1.68 |
| 0.2 | 0.49 | 0.80 |
| 0.4 | 0.33 | 0.68 |
| 0.6 | 0.33 | 0.60 |

*an uninhibited 1% HF solution resulted in an acid attack rate of 143.70 $g/m^2/hr.$ on KWA steel under the same conditions employed for Example 3.

EXAMPLE 4

A concentrate prepared as in Example 1 was added to an acidic cleaning solution having 1% by weight of hydrofluoric acid in the amount of 0.2 percent by volume and 0.4 percent by volume respectively. Clean, scale-free coupons of highly reactive steel alloys WB-36 and KWA were employed. The coupons were weighed and contacted with the respective test solutions by immersion for 4 hours. Tests were performed at various temperatures from 30° C to 95° C. Subsequent to immersion in the respective test solutions, the coupons were rinsed in water, dried and weighed. The attack rate of the respective test solutions was calculated from the weight loss and is compiled in Table 3 below.

TABLE 3

| Temperature (° C | Inhibitor conc (%/vol.) | Acid attack rate ($g/m^2/hr.$) | |
|---|---|---|---|
| | | WB-36 metal | KWA metal |
| 30 | 0.2 | 0.21 | 0.33 |
| 30 | 0.4 | 0.14 | 0.31 |
| 40 | 0.2 | 0.25 | 0.39 |
| 40 | 0.4 | 0.21 | 0.39 |
| 50 | 0.2 | 0.27 | 0.47 |
| 50 | 0.4 | 0.27 | 0.41 |
| 60 | 0.2 | 0.35 | 0.49 |
| 60 | 0.4 | 0.33 | 0.51 |
| 70 | 0.2 | —* | 0.57 |
| 70 | 0.4 | — | 0.58 |
| 80 | 0.2 | 0.35 | 0.70 |
| 80 | 0.4 | 0.41 | 0.66 |
| 90 | 0.2 | 0.49 | 0.80 |
| 90 | 0.4 | 0.33 | 0.68 |
| 95 | 0.2 | —* | 0.74 |
| 95 | 0.4 | — | 0.80 |

*WB-36 metal was not tested at 70° C or at 95° C.

The surface of all the coupons had a desirable bright and shiny appearance.

EXAMPLE 5

A test solution having hydrofluoric acid in the amount of 2% by weight was prepared. To this solution was added at the rate of 4 milliliters per liter, a concentrate prepared as shown in Example 1.

A second test solution was prepared having hydrofluoric acid in the amount of 1% by weight and hydrochloric acid in the amount of 5% by weight, and having in addition the same inhibitor in the same amount as employed in the first test solution.

Test coupons of KWA, 1010 hot-rolled steel, ASTM Type P-1, ASTM Type P-12, and ASTM Type P-11 steels, cleaned and free of scale, were immersed in the respective test solutions at a temperature of 65° C. The rate of acid attack was calculated from the weight loss of the respective steel coupons and is compiled in Table 4 below.

TABLE 4

| Steel type | Acid attack rate ($g/m^2/hr.$) | |
|---|---|---|
| | Solution 1 | Solution 2 |
| KWA | 0.69 | 6.56 |
| 1010 HRS | 0.33 | 1.20 |
| P-1 | 0.88 | 4.78 |
| P-12 | 0.55 | 3.42 |
| P-11 | 0.49 | 3.20 |

EXAMPLE 6

A first solution was prepared having hydrofluoric acid in the amount of 2% by weight and an inhibitor prepared as described in Example 1 in the amount of 0.2% by volume.

A second solution was prepared having hydrofluoric acid in the amount of 2% by weight and an inhibitor prepared as described in Example 2 in the amount of 0.2% by volume.

Specimen coupons of several highly reactive steel alloys were deburred, scale-free and cleaned for contact with the HF cleaning solutions respectively. Specimen coupons of each of the respective alloys were immersed for a period of 4 hours at 90° C in the first solution. In like manner additional coupons of the same reactive alloys were immersed for 4 hours at 90° C in the second solution. Following immersion, the coupons were dried and again weighed to determine the acid attack rate of the respective solutions on the various alloys. The results are compiled in Table 5 below.

TABLE 5

| Metal Type | Acid attach rate ($g/m^2/hr.$) | |
|---|---|---|
| | Solution 1 | Solution 2 |
| 10 Cr Mo910 | 1.26 | 0.95 |
| 13 Cr Mo 44 | 0.69 | 0.75 |
| 15 Mo 3 | 0.69 | 0.69 |
| St. 35.8 | 0.53 | 0.45 |
| WB-36 | 1.48 | 1.16 |
| KWA | 0.32* | 1.20* |
| P-1 | 1.24 | 1.28 |
| P-11 | 0.67 | 0.75 |
| P-12 | 1.12 | 0.95 |
| BHW35-3013 | 0.79 | 0.73 |
| BHW30-3012 | 0.63 | 0.49 |

*concentration of inhibitor was 0.8 percent by volume for the KWA alloy instead of 0.2 percent by volume as employed for the remainder of the alloys. KWA, high chromium steel alloy, is the most reactive of the alloys tested.

EXAMPLES 7 - 15

Liquid concentrates were prepared for Examples 7-15 wherein the amount of thiourea was varied relative to the other ingredients as expressed in Table 6 below. The Mannich base was prepared according to the method of Example 1.

Clean, scale-free panels of KWA stainless steel were weighed and contacted with the solutions of Examples 7-15 respectively by immersion for 4 hours at a temperature of 65° C. Subsequent to immersion the panels were again weighed and the weight loss determined. The acid attack rates for each of the examples was calculated and is compiled in Table 7 below.

TABLE 6

| Example | Ingredients (grams) Mannich base | Triton N-150 | Igepal CO-850 | Isopro-panol | HCl 23° Bé | Water | Thiourea | $FeSO_4$ |
|---|---|---|---|---|---|---|---|---|
| 7 | 45.0 | 9.8 | 30.8 | 12.5 | 5.0 | 0.6 | 0.0 | 7.2 |
| 8 | 45.0 | 9.8 | 30.8 | 12.5 | 5.0 | 0.6 | 0.0 | 12.0 |
| 9 | 45.0 | 9.8 | 30.8 | 12.5 | 5.0 | 0.6 | 7.2 | 7.2 |
| 10 | 45.0 | 9.8 | 30.8 | 12.5 | 5.0 | 0.6 | 7.2 | 0.0 |
| 11 | 45.0 | 9.8 | 30.8 | 12.5 | 5.0 | 0.6 | 12.0 | 0.0 |
| 12 | 45.0 | 9.8 | 30.8 | 12.5 | 5.0 | 0.6 | 18.0 | 0.0 |
| 13 | 45.0 | 9.8 | 30.8 | 12.5 | 5.0 | 0.6 | 24.0 | 0.0 |
| 14 | 45.0 | 9.8 | 30.8 | 12.5 | 5.0 | 0.6 | 30.0 | 0.0 |
| 15 | 45.0 | 9.8 | 30.8 | 12.5 | 5.0 | 0.6 | 36.0 | 0.0 |

TABLE 7

| Example No. | Amount of Concentrate (%/vol.) | Acid attack Rate ($mg/m^2/hr.$) |
|---|---|---|
| 7 | 0.4 | 73.93 |
| 8 | 0.4 | 66.46 |
| 9 | 0.4 | 1.21 |
| 10 | 0.4 | 0.990 |
| 11 | 0.4 | 0.828 |
| 12 | 0.4 | 0.788 |
| 13 | 0.4 | 0.566 |
| 14 | 0.4 | 0.667 |
| 15 | 0.4 | 0.768 |

–40 for comparison purposes. For the same reason, 352 g/l of the same alkyl aryl polyethoxyethanol nonionic surfactants, 5 g/l of water and 108 g/l of isopropanol were additionally included in the concentrates. The appearance of the concentrates was observed and rated: "excellent" when the concentrate was desirably clean and free of precipitate, and "cloudy" when a turbid condition existed. In some cases a precipitate was observed. A "poor" appearance indicated a failure to obtain a stable concentrate composition. The appearance ratings of the concentrates are compiled in Table 8 below.

TABLE 8

| Reaction acid | Formulating acid (43 g/l) Hydroxyacetic (70%) | $H_2SO_4$ (67.5%) | $H_3PO_4$ (86%) | Acetic (99.8%) | Formic (88%) |
|---|---|---|---|---|---|
| 28.3g Hydroxy-Acetic (70%) | 16 Excellent | 21 Excellent | 26 poor | 31 Excellent | 36 Excellent |
| 27.4g $H_2SO_4$[1] (67.5%) | 17 clear,slight ppt. | 22 clear,slight ppt. | 27 poor | 32 poor | 37 clear,ppt. |
| 14.8g $H_3PO_4$[2] (86%) | 18 poor | 23 cloudy,ppt. | 28 poor | 33 poor | 38 Excellent |
| 24g Acetic (99.8%) | 19 clear,very slight ppt. | 24 Excellent | 29 poor | 34 clear,ppt. | 39 clear,ppt. |
| 31.5g Formic[2] (88%) | 20 Excellent | 25 Excellent | 30 poor | 35 slight ppt. | 40 Excellent |

[1]Reaction mixture solidified during the first and second addition of formaldehyde.
[2]Incomplete reactions were noted when employing $H_3PO_4$ or formic acid as the reaction acid.

EXAMPLES 16 - 40

Several concentrate compositions were prepared in the manner of Example 1, except the acid for catalyzing the Mannich reaction was hydroxyacetic, sulfuric, phosphoric, acetic or formic in place of the hydrochloric acid of Example 1. To each of these reaction products, employed in the amount of 387 g/l, was added 207 grams of thiourea, together with one of the above acids employed for catalyzing the Mannich reaction. The acid added with the thiourea is referred to as the formulating acid for purposes of convenient reference. The formulating acid was added in the amount of 43 g/l to maintain uniformity of the concentrates of Examples 16

To illustrate the usefulness of a Mannich base and thiourea inhibitor composition wherein the acid employed to catalyze the Mannich reaction differs from the acid used in formulating a concentrate product, clean, scale-free metal coupons comprised of highly reactive steel alloys were immersed for 4 hours in hydrofluoric acid cleaning solutions of 2 percent by weight concentration, in which were dissolved concentrates according to Examples 1, 16, 21, 31 and 36 respectively. The same procedure was carried out in 1% HF cleaning solutions. The resulting acid attack rate expressed as $gms/m^2/hr.$ is compiled in Table 9 below.

TABLE 9

| Metal | %/vol. | $gms/m^2/hr.$ 2% (wt.) HF Cleaning Solution - 90° C - 4 hrs. Reaction Acid - Formulating Acid - HCl HCl Example 1 | Hydroxyacetic Hydroxy-acetic Example 16 | Acetic Example 31 | Formic Example 36 | $H_2SO_4$ Example 21 |
|---|---|---|---|---|---|---|
| 10 Cr Mo 910 | 0.2 | 1.26 | 0.95 | 0.99 | 1.52 | 1.42 |
| 13 Cr Mo 44 | 0.2 | 0.69 | 0.75 | 0.75 | 0.75 | 0.75 |
| 15 Mo 3 | 0.2 | 0.69 | 0.69 | 0.75 | 0.67 | 0.69 |
| St 35.8 | 0.2 | 0.53 | 0.45 | 0.39 | 0.43 | 0.51 |
| WB - 36 | 0.2 | 1.48 | 1.16 | 0.97 | 0.91 | 1.20 |
| KWA | 0.8 | 1.32 | 1.20 | 1.20 | 1.16 | 1.24 |
| P-1 | 0.2 | 0.24 | 1.28 | 1.22 | 1.20 | 1.30 |
| P-11 | 0.2 | 0.67 | 0.75 | 0.77 | 0.69 | 0.73 |
| P-12 | 0.2 | 1.12 | 0.95 | 0.87 | 1.16 | 1.07 |
| BHW 35 - 3013 | 0.2 | 0.79 | 0.73 | 0.79 | 0.77 | 0.73 |

TABLE 9-continued

| | | gms/m²/hr. | | | | |
|---|---|---|---|---|---|---|
| BHW 30 - 3012 | 0.2 | 0.63 | 0.49 | 0.51 | 0.49 | 0.45 |

| | 1% (wt.) HF Cleaning Solution - 90° C - 4 hrs. | | | | | |
|---|---|---|---|---|---|---|
| Reaction Acid - | | | Hydroxyacetic | | | |
| Formulating Acid - | | HCl | Hydroxy-acetic | Acetic | Formic | $H_2SO_4$ |
| Metal | %/vol. | HCl Example 1 | Example 16 | Example 31 | Example 36 | Example 21 |
| WB - 36 | 0.2 | 0.57 | 0.53 | 0.53 | 0.67 | 0.57 |
| KWA | 0.2 | 0.79 | 0.95 | 1.01 | 0.91 | 0.93 |

EXAMPLES 41 - 44

An aqueous hydrofluoric acid solution having HF in the amount of 1% by weight was first prepared.

EXAMPLE 41

To 250 ml of the hydrofluoric acid solution was added 551 mg of a composition prepared in accordance with Example 1 having a rosin amine Mannich base together with thiourea. A coupon of KWA steel was solvent-wiped and subsequently immersed in the above solution for 4 hours at 90° C. The acid attack rate was determined and the results compiled in Table 10 below under "Example 41".

EXAMPLE 42

To 250 ml of the 1% by weight aqueous hydrofluoric acid solution was added 357 mg of an aqueous composition prepared in accordance with Example 1, except the Mannich base was omitted. The thiourea was thereby provided in the same amount as the thiourea concentration of Example 41.

A coupon of KWA steel was prepared and contacted with this solution in the same manner as in Example 41. The acid attack rate was determined and the results compiled in Table 10 below under "Example 42".

EXAMPLE 43

To a 250 ml quantity of the 1% by weight aqueous hydrofluoric acid solution was added 447 mg of an aqueous composition prepared in accordance with Example 1, except the thiourea was omitted. The Mannich base was thereby provided in the same amount as the Mannich base concentration of Example 41.

A coupon of KWA steel was prepared and contacted with this solution in the same manner as in Example 41. The acid attack rate was determined and the results compiled in Table 10 below under "Example 43".

EXAMPLE 44

To 250 ml of the 1% by weight aqueous hydrofluoric acid solution was added 521 mg of a comparison inhibitor composition. The comparison inhibitor employed a rosin amine Mannich base together with additional inhibiting ingredients. To 449 grams of a reaction product prepared according to steps one and two of Example 1, was added the additional inhibiting ingredients of 26 grams triphenyl sulfonium chloride (TPSC) and 26 grams of propargyl alcohol. There was also present in the comparison inhibitor, 99 grams of Triton N-150 and 310 grams of Igepal CO-850 surfactants, 125 grams of isopropanol and 6 grams of water for each liter of the comparison inhibitor.

A coupon of KWA steel was prepared and contacted with this solution in the same manner as in Example 41. The acid attack rate was determined and the results compiled in Table 10 below under "Example 44".

As a control on the inhibition of acid attack by the solutions of Examples 41–44, a coupon of KWA steel was immersed in the same manner as employed for Examples 41–44, in 250 ml of a 1% by weight aqueous hydrofluoric acid solution without any inhibiting composition. The acid attack rate was determined and the results compiled in Table 10 below under "Control".

TALBE 10

| | Ingredients (mg/l) | | | | | | | | | acid attack |
|---|---|---|---|---|---|---|---|---|---|---|
| Example | Mannich base | Triton N-150 | Igepal CO-850 | Isopro-panol | HCl 20°Bé | $H_2O$ | Thio-urea | TPSC | Propargyl alcohol | rate (g/m²/hr.) |
| 41 | 774 | 170 | 533 | 216 | 86 | 11 | 414 | — | — | 0.73 |
| 42 | — | 170 | 533 | 216 | 86 | 11 | 414 | — | — | 20.91 |
| 43 | 774 | 170 | 533 | 216 | 86 | 11 | — | — | — | 120.94* |
| 44 | 898 | 198 | 621 | 250 | — | 12 | — | 52 | 52 | 123.97* |
| Control | — | — | — | — | — | — | — | — | — | 143.70 |

*Excessive foaming due to a vigorous acid attack on the coupons resulted in a loss of the HF solution whereby about ½ inch (17mm) of the coupon (after 4 hours) was above the solution level.

EXAMPLE 45

To 200 ml of a 5% by weight aqueous hydrochloric acid solution was added in an amount of 0.2% by volume, a comparison composition prepared in accordance with Example 44 having triphenyl sulfonium chloride (TPSC) and propargyl alcohol in addition to the Mannich base.

A coupon of 1010 hot-rolled steel was immersed in the above solution for 4 hours at 82° C. The acid attack rate was determined and is compiled in Table 11 below.

EXAMPLE 46

To 200 ml of a 5% by weight aqueous hydrochloric acid solution was added in an amount of 0.2% by volume, a comparison composition as in Example 45. To the resulting solution was added with stirring, thiourea in the amount of 414 mg/l. The thiourea was present in the above solution in an amount equal to the thiourea in Example 41 above.

A coupon of 1010 hot-rolled steel was immersed in the above solution in accordance with the method of Example 45. The acid attack rate was determined and is compiled in Table 11 below.

TABLE 11

| Acid attack rate of 5% (wt.) hydrochloride acid having comparison compositions outside the scope of the invention. | |
|---|---|
| Example | Acid attack rate ($g/m^2/hr.$) |
| 45 | 0.40 |
| 46 | 1.17 |

It can be seen from Table 11 that the acid attack rate of an HCl solution is apparently increased by the addition of thiourea.

Having described and exemplified the invention, it can be seen that certain variations and substitutions are possible within the scope of the invention, the bounds of which are defined by the following claims.

What is claimed is:

1. A product prepared by reacting an amine having at least one active hydrogen attached to the nitrogen; an alpha ketone selected from the group consisting of acetophenone and acetone; and formaldehyde, in the presence of hydroxyacetic acid.

2. The product of claim 1 wherein the amine is a rosin amine.

3. A process for the preparation of a reaction product of an amine having at least one active hydrogen attached to the nitrogen; an alpha ketone selected from the group consisting of acetophenone and acetone; and formaldehyde, which comprises reacting said amine, alpha ketone and formaldehyde in the presence of hydroxyacetic acid.

4. The process of claim 3 wherein the amine is a rosin amine.

* * * * *